US005947837A

United States Patent [19]

Perry

[11] Patent Number: 5,947,837

[45] Date of Patent: Sep. 7, 1999

[54] ARMPIT GOLFPUTTER HAVING A WEIGHTED TOP PUTTER HEAD

[76] Inventor: Thomas W. Perry, 3211 Brill, Indianapolis, Ind. 46227

[21] Appl. No.: 08/897,021

[22] Filed: Jul. 18, 1997

[51] Int. Cl.[6] ..... A63B 53/00; A63B 53/02

[52] U.S. Cl. ..... 473/313; 473/314; 473/340; 473/350

[58] Field of Search ..... 473/313, 340, 473/341, 314, 350, 294, 293, 296, 276

[56] References Cited

U.S. PATENT DOCUMENTS

| | | | |
|---|---|---|---|
| 3,874,668 | 4/1975 | Flege . | |
| 4,163,554 | 8/1979 | Bernhardt . | |
| 4,227,694 | 10/1980 | Drake . | |
| 4,621,816 | 11/1986 | Leek . | |
| 4,964,639 | 10/1990 | Tucker . | |
| 5,156,401 | 10/1992 | Hodgkiss . | |
| 5,209,474 | 5/1993 | Voyer . | |
| 5,460,375 | 10/1995 | Hardee | 473/300 |
| 5,465,971 | 11/1995 | Tischler . | |
| 5,470,070 | 11/1995 | Bendo | 473/252 |
| 5,494,282 | 2/1996 | Pranio | 473/313 |
| 5,520,392 | 5/1996 | Foresi et al. . | |
| 5,533,728 | 7/1996 | Pehoski | 473/252 |
| 5,544,879 | 8/1996 | Collins | 473/314 |
| 5,575,472 | 11/1996 | Magerman | 29/530 |
| 5,685,784 | 11/1997 | Butler | 473/340 |

*Primary Examiner*—Sebastiano Passaniti
*Assistant Examiner*—Stephen L. Blau
*Attorney, Agent, or Firm*—Walter R. Baylor, Esq.

[57] ABSTRACT

A golf putter structural arrangement includes an elongated head having top and bottom surfaces. The head has a back side and two ends. An elongated onset hosel has a front edge and a back edge with the front edge being connected to the front side surface. The back edge has a downwardly extending chamber formed under the top surface of the hosel. A shaft member is mounted on the back of the hosel and extends upwardly at an angle so as to be adaptable to be extended through the armpit of a golfer. Thereby the arrangement operatively creates an overspin on a golf ball and provides for a more accurate and consistent putting stroke. Wherein the back edge includes a backwardly and downwardly extending top section joining with a backwardly and upwardly extending bottom section, the top and bottom sections forming an integrally formed protrusion having an oblong configuration. Further, the structural arrangement includes T-shaped guide lines mounted on the hosel for assisting the golfer in lining up a putting operation.

8 Claims, 3 Drawing Sheets

ARMPIT GOLFPUTTER HAVING A WEIGHTED TOP PUTTER HEAD

BACKGROUND OF THE INVENTION

1. Field of the Invention

The present invention relates to an armpit golf putter having a weighed top putter head.

2. Description of the Prior Art

In the prior art, first, there was metal woods. Then there was "heel and toe weighted" golf putters. Next, there was "cavity back" irons and "oversize titanium" woods. The game of golf requires a golfer to have the ability to perform with different golf clubs over a wide range of circumstances. A major part of golf is putting, which requires the highest degree of precision. This precision is accomplished by practice and, if a golfer desires to improve his/her putting, a considerable amount of practice time is required to develop a correct putting stroke. The art of putting requires substantially different skills than are necessary when using other clubs. There are a large number of different putting strokes, each of which differs from the other. However, these putting strokes all have in common the need to precisely repeat the putting stroke each and every time if a high degree of skill in putting is to be acquired. The putting stroke, to be truly effective, requires that the golfer acquire a form and discipline that is both unique and unnatural as compared with other clubs. Form, techniques, grip and execution are all critical functions of putting, and difficulties arise in precisely repeating them from one putting stroke to the next.

The secret to putting is to create an overspin on a golf ball so the ball will hug the green and stay "on line." Putts hit to the right or left side of the cup will not "spin out." The overspin on the ball will cause these putts to actually dive into the cup.

Most golf putter heads are heel and toe weighted to create a larger "horizontal" sweet spot. They have very little mass at the center and top of the putter head. Sole weighted golf clubs are designed to impart more backspin and loft with a full golf shot. Golf putters, on the other hand, should impart overspin so the ball will hug the surface of the green as it rolls towards the hole. With the sole weighted golf putters, the putt must be hit perfectly with an upstroke to create the proper overspin. If not stroked perfectly then backspin or sidespin will be imparted on the golf ball which causes the putt to move off line and spin out.

One has heard the saying "Drive for Show and Putt for Dough." How true this is. A typical round of golf requires 14 drives and 30 to 36 putts. If the golfer can improve the putting by 10%, he/she can shave 3 or 4 strokes off the score. If the putting can be improved by 20%, the golfer can shave 6 or 7 strokes off the score. The structural arrangement of the instant invention provides the means to achieve this goal.

Putting is both an ART and a SCIENCE. The ART of putting requires a visualization or proper "read" of the slope and grain of the green and a feel for the distance of the putt. The SCIENCE of putting is a mechanical action which requires taking the correct aim and execution of the putting stroke in a manner which is repeatable.

Mechanical failure of a putting stroke causes the golfer to either "push" the putter off of the intended line to the right or "pull" the putter off of the intended line to the left. Generally, mechanical breakdown occurs in the small muscles of the hands, arms and wrists. The golfer can accomplish a significant improvement in putting by transferring the mechanical action of the stroke from the small muscles of the hands, arms and wrists to the large muscles of the shoulders. With the putter of the instant invention the golfer only uses the large muscles of the shoulder. The armpit acts as a socket to hold the top part of the putter shaft. The golfer can virtually eliminate a "push" or "pull" of a putt.

Kinetic energy of the club head is imparted to the ball thereby causing it to travel in a particular direction with a rolling motion, the attitude of the striking face upon impact with the ball tends to impart a slight topspin to the ball.

Various arrangements for a golfer that permits he/she to obtain improved control over putting of a golf ball are well known in the patent literature, as exemplified by the following patents: U.S. Pat. No. 3,874,668, issued on Apr. 1, 1997 to Fledge, discloses a club head with a vertical shaft extending upwardly from the center of the club head with the top of the shaft having a C-shaped band projecting perpendicularly to the shaft and adapted to support the shaft about the upper portion of the golfer's arm, the shaft being bent intermediate along the club head and top end into a V-shape with the top leg of the V defining a handle. U.S. Pat. No. 4,163,554, issued on Aug. 7, 1979 to Bernhardt, discloses a golfing putter having an elongated shaft being joined to the head by means of a connecting neck portion and axis of the shaft which diverges from the vertical axis of the head which is at an angle to the striking face. U.S. Pat. No. 4,227,694, issued on Oct. 14, 1980 to Drake, discloses an arm-assisting golf putter having an inverted T-shaped head having a central neck portion, an upwardly-directly rearwardly-inclined intermediate portion and a vertical upper portion. U.S. Pat. No. 4,621,816, issued on Nov. 11, 1986 to Leek, discloses a golf putter in which the shank portion of the shaft is connected with the head above one or more of the putting faces and the head is positioned remote from the golfer by a connection between the shank and the handle. U.S. Pat. No. 4,964,639 issued on Oct. 23, 1990 to Tucker, discloses a putter which is positioned by grasping the shaft at about mid-length whereby the free end of the shaft extends up the forearm of the gripping hand. U.S. Pat. No. 5,156,401, issued on Oct. 20, 1992 to Hodgkiss, discloses a putter training device wherein a cross-piece abuts a user's chest so that end portions extend behind a user's arms. U.S. Pat. No. 5,209,474, issued on May 11, 1993 to Voyer, discloses a golf putter wherein a medial stabilization portion and an upper stabilization portion is received in the crook of a golfer's arm and the upper stabilization portion contacts the outer surface of the golfer's upper arm. U.S. Pat. No. 5,465,971, issued on Nov. 14, 1995 to Tischler, discloses a putting training device that is affixed to the handle, such that the device projects upwardly from the handle. The reference device includes an elongated rod that has an insertion post on one end and a crutch-arm on the other, whereby the crutch-arm engages and fits under the rearward armpit of the golfer. U.S. Pat. No. 5,520,392, issued on May 28, 1996 to Foresi et al., discloses a golf training device wherein the distal end of an elongated member includes a bent section terminating in a mechanism for attaching that end to the shaft whereby the device adopts a pendulum-like putting swing.

None of the above references disclose a golf putter structural arrangement that includes: an elongated head having top and bottom surfaces, a front side surface, a back side surface, and two end surfaces, with the front side surface constituting the golf ball striking surface; an elongated onset hosel having a back edge, and being mounted at an angular relationship to the head; a shaft being mounted on the the back of the hosel and extending upwardly at an angle so as to extend through the armpit of the golfer; and thereby the golf putter structural arrangement of the instant invention operatively creating an overspin on a golf ball.

None of the above inventions and patents, taken singly or in combination, is seen to describe the instant invention as claimed.

SUMMARY OF INVENTION

The putter of the present invention will assist a golfer to execute and to repeat the same putting stroke every time. When the golfer has confidence in the stroke then the golfer is able to concentrate totally on the "read" and make more putts.

A T-Roll™ golf putter of the instant invention is both horizontally and vertically balanced. A Roll Bar™ on the T-roll™ armpit golf putter shifts weight from the sole towards the top of the putter head. A hosel of the instant invention has been referred to as a Roll Bar™ because the structural arrangement for such a golf putter assists in creating an overspin to a golf ball. This added weight at the top of the putter head moves the center of mass of the putter head above the golf ball which helps to create an overspin on the golf ball so the putt will stay on line. The Roll Bar™ insures a more consistent roll even on mishit putts. The shaft is connected to the back of the Roll Bar™ creating the most solid feeling possible. The face of the putter head is machine milled to create a smooth surface.

The T-Roll™ armpit is not just another long putter. It is a new way of putting. It is designed to putt with a different technique. It has a solid bronze head which is slightly heavier than the head of a conventional putter. A shaft for a long golf club has a length in the range of fifty-two inches to fifty-four inches and such a shaft has a long grip. The grip can be made with a heavy rubber tape which is slightly tacky. The shaft is designed to extend under and through the left armpit (for right handed golfers). The armpit acts as a socket to hold the top part of the putter shaft. The hands are placed on the lower part of the grip of the shaft just like a normal putter. Due to the angle of the shaft extending from the left armpit through the hands and down behind the ball, the shaft is connected to the back of the Roll Bar™. This allows the hands to be placed slightly in front of the golf ball and the eyes directly over the golf ball. On the back stroke the shoulders keep the golf putter head on line. It is much easier to hold the putter on line by using the large shoulder muscles than by using the smaller muscles of your wrists and arms. Take the putter straight back by making a slight shoulder turn to the right. Keep your eye on the golf ball. Begin the forward stroke by making a slight shoulder turn to the left and follow through to the hole. Once the golfer develops a feel for distance then your putting will improve dramatically.

It is a principle object of the invention to provide a golf structural arrangement having top and bottom surfaces. The head has a front side which constitutes a golf ball striking surface. Further, the head has a back side and two ends. An onset hosel has a back edge which has a downwardly extending chamber formed under a top surface of the hosel. A shaft member is mounted on the back of the hosel and extends upwardly at an angle so as to be adaptable to be extended through the armpit of a golfer. Thereby the golf putter structural arrangement operatively creates an overspin on a golf ball and provides for a more accurate and consistent putting stroke. Further, the structural arrangement includes a series of guide lines mounted on the top surface of the hosel.

It is an object of the invention to provide an improved golf putter having an angular mounted hosel which allows a shaft to extend upwardly to and under the armpit of a golfer.

It is a further object of the invention to provide an improved golf putter having a bar attached to a shaft and top of a putter head thereby creating an overspin on the golf ball.

It is a further object of the invention to provide an improved golf putter wherein an added weight of the bar is towards the top of the head, thereby moving the center of mass of the putter head above the center of a golf ball.

It is a further object of the invention to provide a golf putter that allows for a more natural and comfortable grip on the putter.

It is a further object of the invention to provide a golfer to have increased control over the relationship between the club face on the putter head and the golf ball.

It is a still further object of the invention to provide a golf putter wherein the effective swing of the putter is reduced to a more compact and simple motion that is easily acquired and repeatable by a user of the putter.

It is a still further object of the invention to provide improved elements and arrangements thereof in a golf club for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
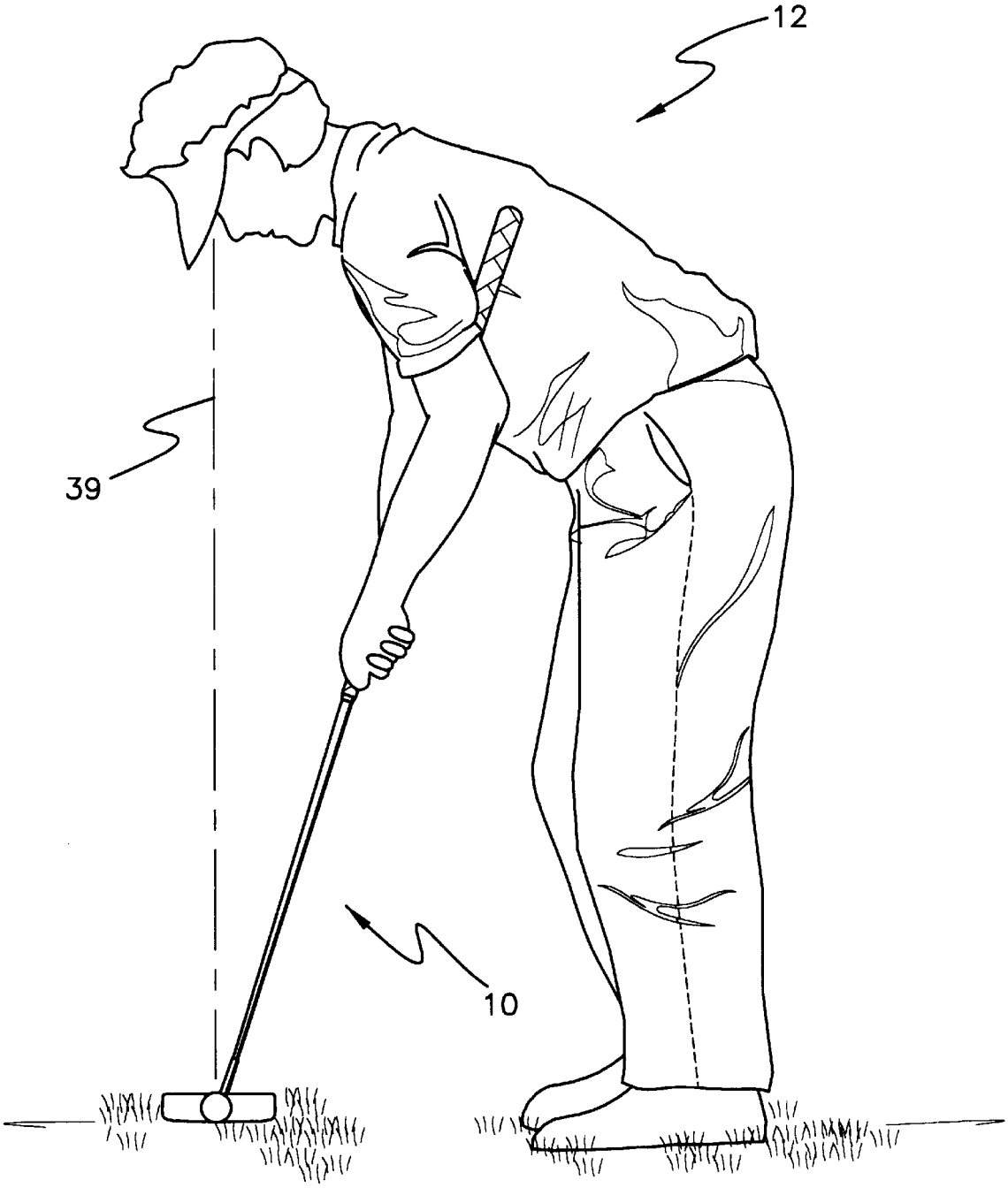
FIG. 1 is an environmental perspective view of the golf putter in the hands of the golfer, in accordance with the present invention.
Figure 2:
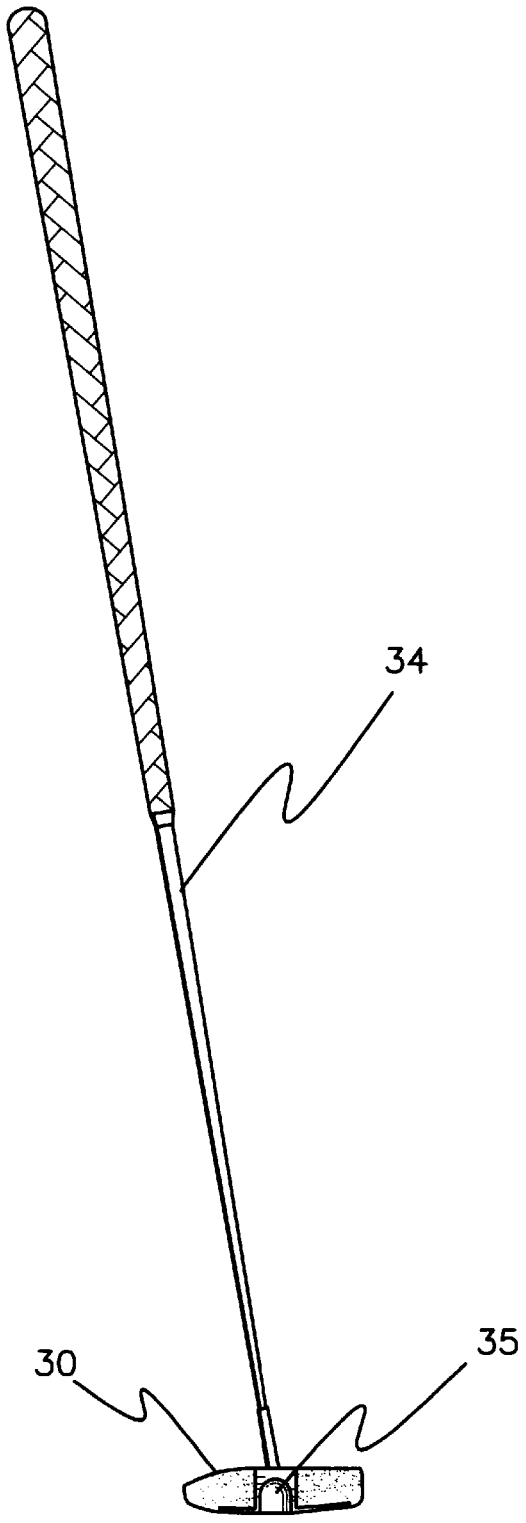
FIG. 2 is a rear view of the golf putter.
Figure 3:
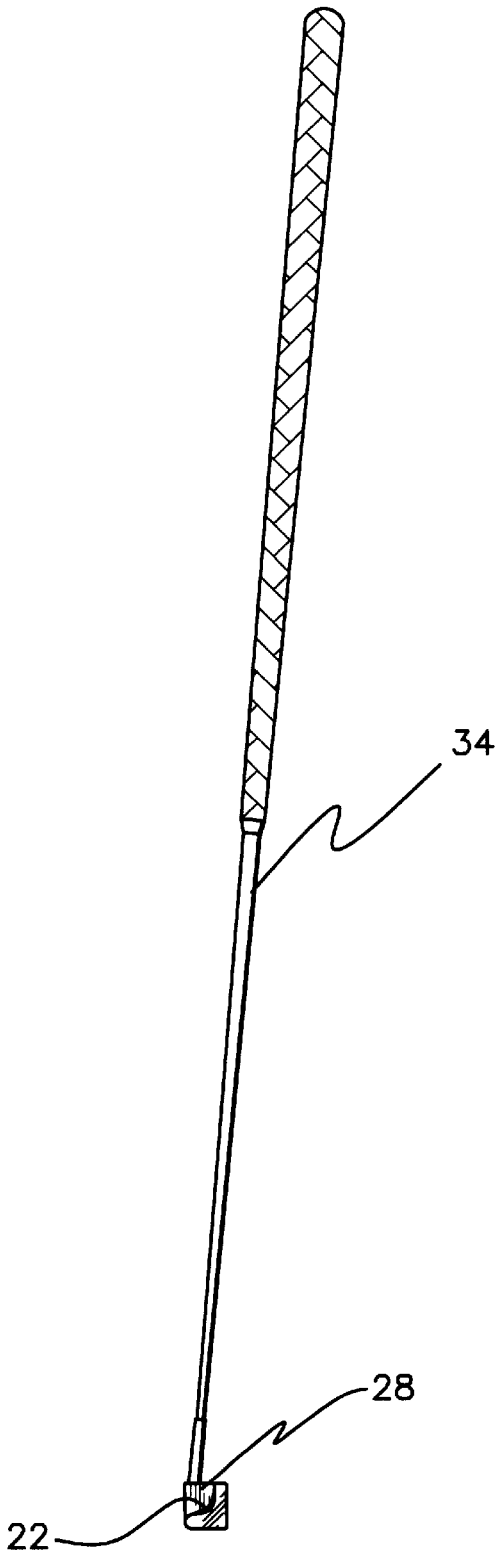
FIG. 3 is a side view of the golf putter.

Referring to FIG. 1, the golf putter of the present invention is designated by the reference character 10. The golf putter 10 is being held by a golfer 12 in a putting stance. This allows the hands to be placed slightly in front of the golf ball and the eyes directly over the golf ball, as shown in FIG. 1. The structural arrangement of the golf putter 10 includes an elongated head 14 having a top surface 16 and a bottom surface 18, and a front side surface 20. The front side surface 20 constitutes a golf ball striking surface, which surface is machine milled thereby creating a smooth surface. The head 14 includes a back side surface 22 and two end surfaces 24, 26. Further, the golf putter 10 includes an elongated or rectangular-shaped onset hosel 28 having a front edge 30 and a back edge 32. The onset hosel 28 is integrally formed with the head 14. The front edge 30 coincides with the front side surface 20. A golfer viewing the herein described head-hosel unit 14, 28 from above and looking in a downwardly direction at the unit, would see a substantially T-shaped configuration formed by the top surface of the head-hosel unit. The back side surface 22 32 includes a backwardly and downwardly extending top section 36 joining with the bottom section 18. These top and bottom sections form an integrally designed protrusion or projection having a substantially oblong configuration. The back edge 32 has a chamber or depression area 35 which is open in its downwardly and rearwardly directions. Further, the golf putter 10 includes a shaft 34 which is mounted on the back of the hosel and which extends upwardly at an angle so as to extend through the armpit of the golfer 12. The golf putter structural arrangement 10 operatively creates an overspin on the golf ball and provides for a more accurate and consistent putting stroke.

The head 14 is made of a heavy metal such as bronze. Thus, the bronze head 14 is slightly heavier in weight than a conventional putter.

In practicing the instant invention, a long shaft-type or a conventional length shaft may be utilized. A shaft for a so-called long golf club has a length in the range of fifty-two to fifty-four inches.

Figure 4:
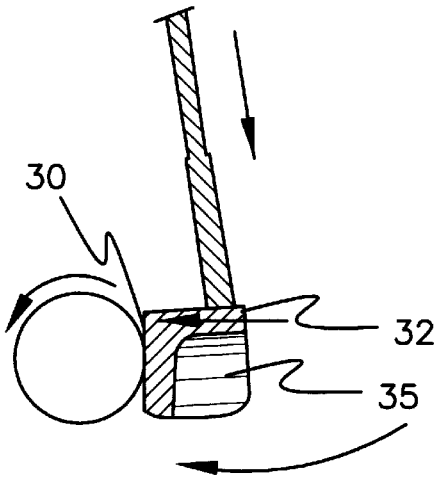
FIG. 4 is a partial perspective view of the golf putter showing the movements of the club and the ball.

Accordingly, the golf putter structural arrangement 10 of the instant invention operatively creates an overspin on the golf ball. In FIG. 4, the movement for the overspin is shown by a series of arrows. The overspin is partially created by the added weight which exists at the top of the putter head 14. The dotted line indicates the line of sight 39 to the top of the ball. Thereby the golf putter structural arrangement 10 can create the desired overspin on the golf ball. The created overspin is due to added weight towards the top of the putter head 14. Thereby the added weight raises the center of mass of the putter head 14 above the center of the golf ball.

Figure 5:
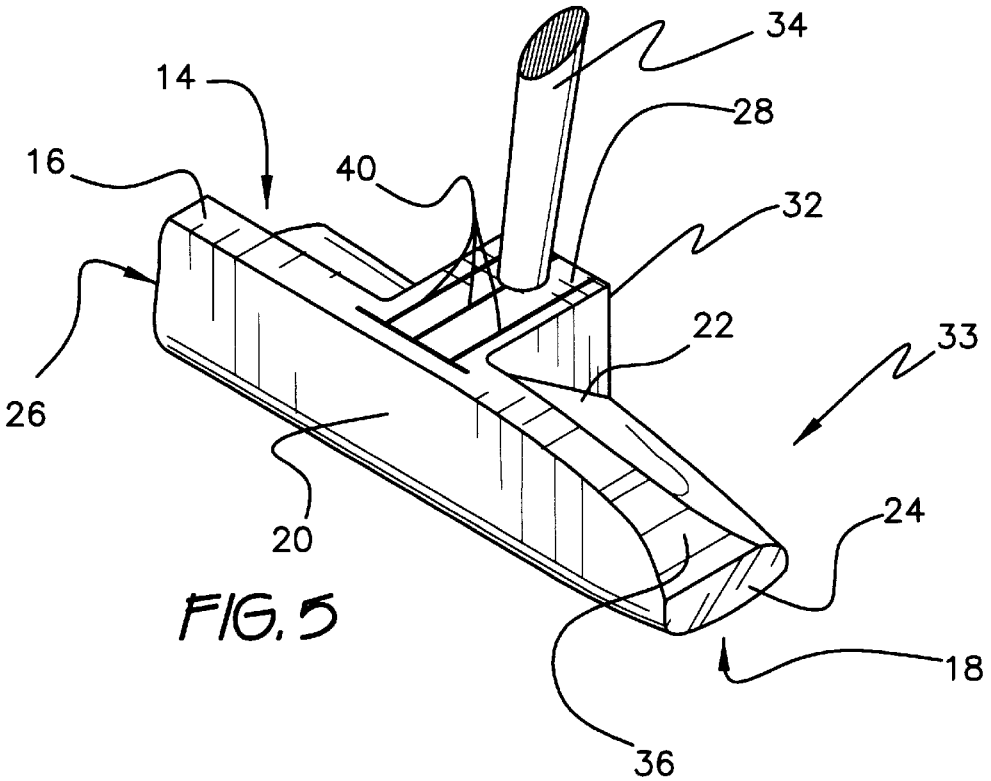
FIG. 5 is a partial perspective view of the components of the present invention.

As seen in FIG. 5, the golf putter structural arrangement 10 includes T-shaped guide lines 40 mounted on the median of the top surface 16 of the head 14 and the hosel 28. The guide lines 40 assist a golfer in lining up a putting operation.

The hosel of the instant invention has been referred to as a Roll Bar™ because the structural arrangement for such a golf putter assists in creating an overspin to a golf ball.

It is to be understood that the present invention is not limited to the embodiment described above, but encompasses any and all embodiments within the scope of the following claims. For example, the golf putter of the instant invention has been described and shown as a substantially integral unit, but it would be obvious to the technician familiar with the golf club art to manufacture the golf putter of the instant invention whereby its parts can be easily assembled/disassembled for the purpose of transport.

I claim:

1. A golf putter structural arrangement, comprising:

an elongated putter head having a bottom surface and a top surface; said head having a front side surface, said front side surface constituting a golf ball striking surface;

said head having a back side surface, and two end surfaces;

an elongated onset hosel having a front edge and a back edge, said front edge being connected to said top surface, said back edge having a downwardly extending chamber formed under a top surface of the hosel; and a shaft mounted on a back of the hosel and extended upwardly at an angle so as to be adaptable to be extended through the armpit of a golfer; and thereby the golf putter structural arrangement operatively creating an overspin on a golf ball and providing for a more accurate and consistent putting stroke;

wherein said back edge includes a backwardly and downwardly extending top section joining with a backwardly and upwardly extending bottom section, said top and bottom sections forming an integrally formed protrusion having an oblong configuration.

2. A golf putter structural arrangement according to claim 1, wherein said front side surface is machine milled for creating a smooth surface.

3. A putter structural arrangement golf arrangement according to claim 1, wherein said hosel has a substantially rectangular shape.

4. A golf putter structural arrangement according to claim 1, wherein said head is made of a heavy metal.

5. A golf putter structural arrangement according to claim 4, wherein said heavy metal is bronze.

6. A golf putter structural arrangement according to claim 1, wherein said shaft has a length in the range of fifty-two inches to fifty-four inches.

7. A golf putter structural arrangement according to claim 1, includes an aligning means mounted on said top surface of the hosel;

thereby assisting the golfer in lining up a putting operation.

8. A golf putter structural arrangement according to claim 1, wherein said aligning means is T-shaped guide lines.

* * * * *